US007665188B2

(12) United States Patent
Landmesser

(10) Patent No.: US 7,665,188 B2
(45) Date of Patent: Feb. 23, 2010

(54) APPARATUS ON A CARDING MACHINE FOR COTTON, SYNTHETIC FIBRES AND THE LIKE, IN WHICH AT LEAST ONE FLAT BAR WITH A FLAT CLOTHING IS PRESENT

(75) Inventor: Thomas Landmesser, Erkelenz (DE)

(73) Assignee: Trützschler GmbH & Co. KG, Moenchengladbach (DE)

( * ) Notice: Subject to any disclaimer, the term of this patent is extended or adjusted under 35 U.S.C. 154(b) by 394 days.

(21) Appl. No.: 11/705,716

(22) Filed: Feb. 14, 2007

(65) Prior Publication Data

US 2007/0186386 A1 Aug. 16, 2007

(30) Foreign Application Priority Data

Feb. 14, 2006 (DE) ..... 10 2006 006 944

(51) Int. Cl.
*D01G 15/24* (2006.01)

(52) U.S. Cl. ..... 19/113; 19/114

(58) Field of Classification Search ..... 19/102, 19/104, 113, 114
See application file for complete search history.

(56) References Cited

U.S. PATENT DOCUMENTS 4,757,575 A 7/1988 Varga
6,101,680 A * 8/2000 Naf et al. ..... 19/102
6,578,237 B1 * 6/2003 Patelli et al. ..... 19/108
6,691,373 B2 * 2/2004 Leder ..... 19/98
6,704,970 B2 * 3/2004 Ebenhoh et al. ..... 19/114
7,020,932 B2 * 4/2006 Breuer et al. ..... 19/104
7,073,229 B2 * 7/2006 Breuer et al. ..... 19/102
2002/0157216 A1 10/2002 Graf

FOREIGN PATENT DOCUMENTS

CH 664 165 A5 11/1984
DE 745 707 A 3/1944

(Continued)

OTHER PUBLICATIONS

German Search Report dated Aug. 22, 2006, issued in 10 2006 006 944.7.

(Continued)

*Primary Examiner*—Shaun R Hurley
(74) *Attorney, Agent, or Firm*—Venable LLP; Robert Kinberg; Justine A. Gozzi

(57) ABSTRACT

In an apparatus on a carding machine for cotton, synthetic fibers and the like, in which at least one flat bar with a flat clothing is present, in which a clothing strip having a flat clothing, preferably wire hooks, arranged in a strip-form support element, is secured to a support body of the flat bar and lies opposite the clothing of a roller, e.g. the cylinder, the spacing between a surface defined by the tips of the flat clothing and the tip circle of the cylinder clothing decreases in the direction of rotation of the cylinder. In order to be able to alter and adapt the angle (offset) in a simple manner in terms of mechanical engineering, the top face, of the clothing strip and the tip surface of the flat clothing are not aligned parallel with one another.

20 Claims, 5 Drawing Sheets

FOREIGN PATENT DOCUMENTS

| | | | |
|---|---|---|---|
| EP | 0 866 153 | A1 | 9/1998 |
| EP | 1 219 735 | A1 | 7/2002 |
| GB | 1 309 229 | A | 3/1973 |
| GB | 2 400 863 | A | 10/2004 |
| GB | 2 428 049 | A | 1/2007 |

OTHER PUBLICATIONS

United Kingdom Search Report, Dated Jul. 7, 2007, Issued in GB 0 702 581.0.

* cited by examiner

APPARATUS ON A CARDING MACHINE FOR COTTON, SYNTHETIC FIBRES AND THE LIKE, IN WHICH AT LEAST ONE FLAT BAR WITH A FLAT CLOTHING IS PRESENT

CROSS REFERENCE TO RELATED APPLICATION

This application claims priority from German Patent Application No. 10 2006 006 944.7, dated Feb. 14, 2006, the entire disclosure of which is incorporated herein by reference.

BACKGROUND OF THE INVENTION

The invention relates to an apparatus on a carding machine for cotton, synthetic fibres and the like, in which at least one flat bar with a flat clothing is present.

In practice, in the case of the flat system of a flat card, the flat bar is set at an angle (what is known as the taper or offset) to the tangential cylinder plane. This has inter alia the following advantages over the central arrangement:

the narrowest spacing of the cylinder is at a defined adjustment edge (heel) which can be emptied out well;

The material gradually enters a tapering gap and is opened/cleaned in an improved manner.

In certain known arrangements the flat clothing, preferably wire hooks, arranged in a strip-form support element is secured to a carrier body of the flat bar, and lies opposite the clothing of a roller, e.g. the cylinder, the spacing between the tip plane of the flat clothing and the tip circle of the cylinder clothing decreases in the direction of rotation of the cylinder, and the tip plane of the flat clothing and a notional surface—arranged parallel to the tangent to the tip circle of the cylinder clothing at the narrowest point—are arranged at an angle β to one another.

In the case of one known apparatus EP 0 866 153 A, a carrier body (profiled member) having a bottom face is present, to which a flexible clothing comprising a carrier layer (base) and hooks embedded therein is secured. The base is adhesively secured to the foot part. The flat bar is guided in its working position (in the main carding zone) such that the tips of the hooks lie in a catchment plane (tip plane) which comprises a very narrow point or very narrow carding line opposite the outer surface of the cylinder. The catchment plane forms an angle β with a notional surface, the notional surface being arranged parallel to the tangent that intersects the outer surface at the above-mentioned narrowest point. To produce the angle β, the flat bar and the carrier body respectively must be designed within an inclination at a corresponding angle, and be both manufactured and mounted at an inclination, i.e. the inclination of the carrier body in relation to the tangent to the outer surface, and hence the angle β, is fixed for each card flat. When the carrier layer with the clothing is exchanged due to wear, the angle β remains the same owing to the parallel arrangement of the top and bottom faces of the carrier layer. With this apparatus, alteration of the angle β or adaptation to changed technical requirements is only possible through a change in the inclination of the carrier body, which is expensive in mechanical engineering terms.

SUMMARY OF THE INVENTION

It is an aim of the invention to produce an apparatus of the kind described initially, which avoids or mitigates the said disadvantages and which in particular allows alteration and adaptation of the angle (offset, taper) in a simple manner in terms of construction.

The invention provides a card flat for use on a carding machine, comprising a support body and a clothing strip, the clothing strip comprising clothing arranged in a clothing carrier layer with the clothing having tips which define a tip surface, wherein the clothing strip comprises an upper surface, and said upper surface and the tip surface defined by the clothing tips are oriented in non-parallel relationship.

The notional surface defined by the clothing tips is referred to below as the "tip surface" and, in preferred embodiments in which the notional surface defined by the clothing tips is a substantially planar surface, as the "tip plane".

Because the top face and the tip surface are not aligned parallel to one another, i.e. the clothing strips other than rectangular in cross-section, as the carrier layer is being exchanged it is easy to alter the angle (taper), that is, to adjust the spacing between flat clothing and cylinder clothing. Alternatively, an exchange can also be advantageous even when the clothings are not worn, if the angle is to be changed for optimum co-ordination with the fibre material to be processed and/or with an increased production capacity. Advantageously, a clothing on a revolving flat with integrated offset is produced.

In a preferred arrangement, the tip surface is substantially planar and the upper surface of the clothing strip and the tip surface of the flat clothing are arranged at an angle to one another. The carrier element of the clothing strip may be of substantially wedge-shaped construction. As well, or instead, an intermediate layer, for example, adhesive, of the clothing strip may be of substantially wedge-shaped construction. In yet a further embodiment, a top element, for example, sheet metal strip, of the clothing strip may be of substantially wedge-shaped construction. Advantageously, the clothing strip consists of at least two layers, at least one layer being of substantially wedge-shaped construction. It may be advantageous for the angle between the tip surface of the flat clothing and a notional surface running parallel to the tangent to the tip circle of the cylinder clothing to decrease in the direction of rotation of the cylinder. Advantageously, the cylinder clothing forms a heel at the smallest spacing between the tip surface of the flat clothing and the tip circle of the cylinder clothing. Advantageously, the top layer of the clothing element consists of a sheet metal strip, for example, steel band. Advantageously, the top layer and the carrier layer of the clothing strip are joined to one another, for example, by adhesion. Advantageously, the top face of the clothing strip and the bottom face of the support body are reversibly detachably joined to one another. For example, a top face of a top element of the clothing strip and the bottom face of a magnetic element may be reversibly detachably joined to one another. Preferably, in such arrangements, at least one magnetic element is associated with the bottom face of the support body. In that manner, the clothing strip can be exchangeable and/or the clothing carrier layer is exchangeable. If desired, the clothing of the flat bar may have a curved tip surface. For example, the tip surface may be concavely curved or convexly curved. In some embodiments, the non-parallel alignment may extend over only a part of the width of the clothing and the clothing strip respectively.

It may be desirable in some circumstances for—viewed in the direction of rotation of the cylinder—a constant spacing coaxial to the mid point of the cylinder to adjoin the non-parallel alignment. If desired, the flat clothing may have regions of different clothing parameters, for example wire length, wire thickness, piercing depth, pile configurations, base thickness. In that case, the tips of the flat clothing may be divided into groups, each group having tips that are used to form a fibre zone, and the groups advantageously each forming a tip surface. In one preferred embodiment, the clothing set into the carrier layer, for example, fabric or the like, consists of wires or the like, which are bent approximately in a U-shape and are inserted so that the cross-member of the U-shaped wires or the like runs on the rear side of the carrier element. The flat bar may be part of a revolving flat. The flat bar may instead be a stationary carding element. Advantageously, a flexible clothing is present, for example, comprising a carrier and clothing tips, wires, hooks or the like. Advantageously, the clothing carrier layer is strip-form. The clothing may consist of saw tooth wire strips for example, all-steel clothing. Expediently, the clothing is mounted on the flat bar in the region of the bottom face. Advantageously, a carrier element of three clothing strips (textile material) is arranged in a recess in the bottom face. The recess may be defined by at least two lateral webs or similar on the longitudinal sides of the flat foot. In one preferred embodiment, a clothing strip is received in the recess, additionally a sheet metal plate being fixed to the clothing support layer via a compensating layer of adhesive, which sheet metal plate is brought into connection with a magnet provided on the flat bar. Thus, advantageously, a sole of a magnetic material is arranged on the rear side of the flat clothing. The sole may be a steel band, sheet metal or similar. Advantageously, laterally the sole has extensions, webs or the like bent at an angle. Preferably, the magnetic component, for example, magnetic band, magnetic strip, magnetic rod or the like, extends in the longitudinal direction of the flat bar.

Advantageously, the flat body is an extruded profile of a light metal, for example, aluminium. Preferably, the extruded profile is a hollow profile. Two end head parts (flat heads) may advantageously be associated with the flat body. In certain embodiments, the flat body consists of fibre-reinforced plastics material. In that case, a magnetic element, where present, can be integrated in the fibre-reinforced plastics material. In one preferred embodiment, at least one and preferably each of the edge regions of the carrier element adjoining the longitudinal edges is set with tips.

The invention thus provides a flat system for a flat card for cotton, synthetic fibres and the like, in which at least one flat bar with a flat clothing strip is present, in which the flat clothing, preferably wire hooks, arranged in a strip-form carrier layer is secured to a support body, in which a top face of a clothing strip comprising the carrier layer and the tip surface of the flat clothing are not aligned parallel to one another.

The invention also provides a flexible clothing for a flat bar on a carding machine for cotton, synthetic fibres and the like, having a flat clothing strip in which the flat clothing, preferably wire hooks, is arranged in a strip-form carrier layer, in which the top face of the clothing strip and the tip surface of the flat clothing are not aligned parallel to one another.

Furthermore, the invention provides a flat card having a revolving flat assembly for cotton, synthetic fibres and the like, in which at least one flat bar with a flat clothing strip is present, in which the flat clothing, preferably wire hooks, arranged in a strip-form carrier layer is secured to a support body and lies opposite the clothing of a roller, for example, the cylinder, and the spacing between the tip surface of the flat clothing and the tip circle of the cylinder clothing decreases in the direction of rotation of the cylinder, in which the top face of the clothing strip and the tip surface of the flat clothing are not aligned parallel to one another.

In certain embodiments, the clothing strip has a marking, which indicates the alignment of the preferred wedge shape.

The invention also provides an apparatus on a carding machine for cotton, synthetic fibres and the like, in which at least one flat bar with a flat clothing is present, in which a clothing element having a flat clothing, preferably wire hooks, arranged in a strip-form support element, is secured to a support body of the flat bar and lies opposite the clothing of a roller, e.g. the cylinder, the spacing between the tip surface of the flat clothing and the tip circle of the cylinder clothing decreases in the direction of rotation of the cylinder, and the tip surface of the flat clothing and a notional surface—arranged parallel to the tangent to the tip circle of the cylinder clothing at the narrowest point—are arranged at an angle to one another, wherein the top face of the clothing strip and the tip surface of the flat clothing are not aligned parallel with one another.

DETAILED DESCRIPTION OF PREFERRED EMBODIMENTS

Figure 1:
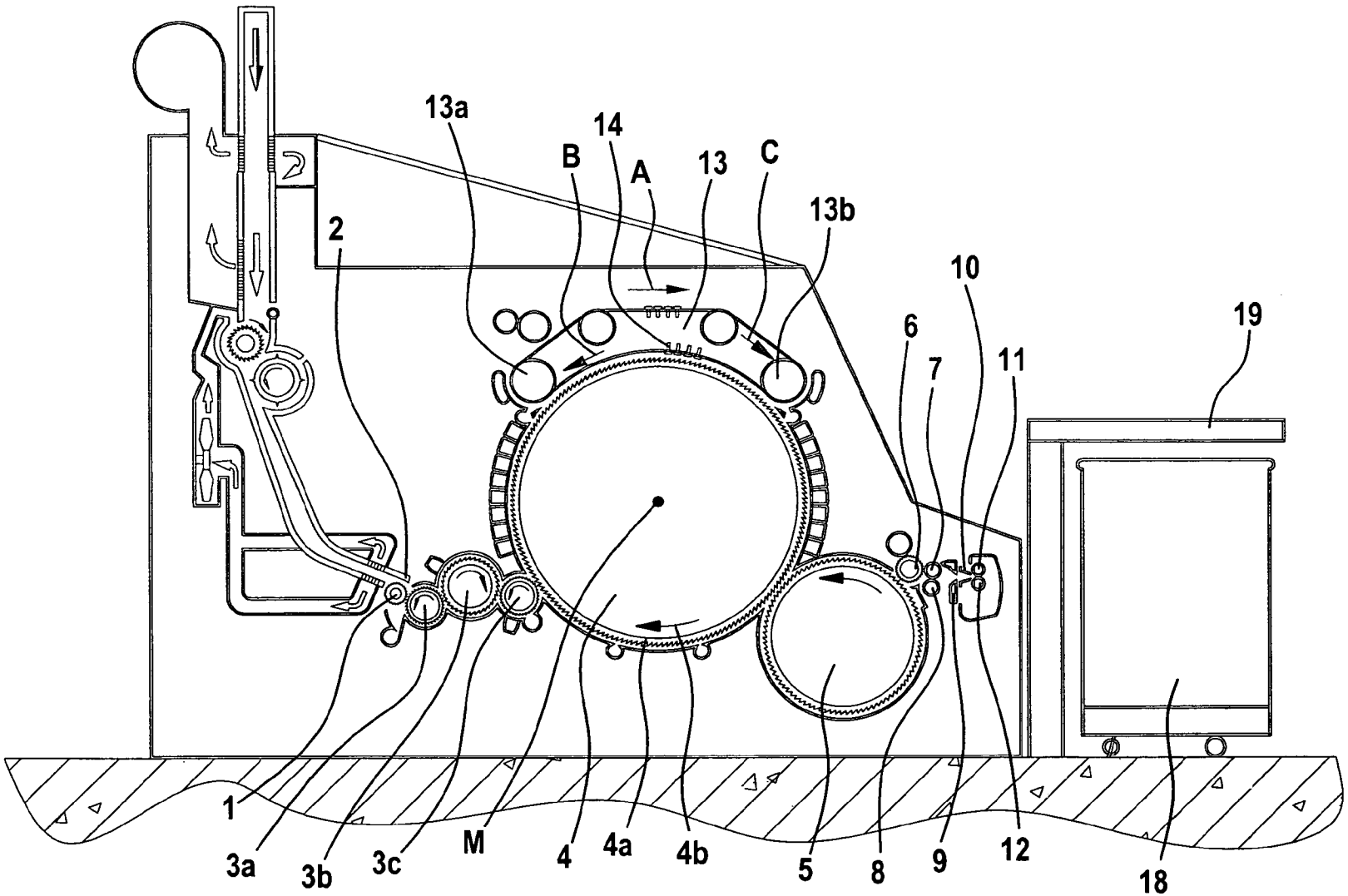
FIG. 1 is schematic side view of a carding machine in which there may be used an apparatus according to the invention.

With reference to FIG. 1, a flat card, for example, a flat card known as the TC 03 (Trade Mark), made by Trützschler GmbH & Co. KG. of Mönchengladbach, Germany, has a feed roller 1, feed table 2, licker-ins 3*a*, 3*b*, 3*c*, cylinder 4, doffer 5, stripping roller 6, squeezing rollers 7, 8, web-guide element 9, web funnel 10, take-off rollers 11, 12, revolving flat 13 with flat guide rollers 13*a*, 13*b* and flat bars 14, can 18 and can coiler 19. The directions of rotation of the rollers are shown by respective curved arrows. The letter M denotes the midpoint (axis) of the cylinder 4. The reference numeral 4*a* denotes the clothing and 4*b* denotes the direction of rotation of the cylinder 4. The letter A denotes the working direction. Arrow B denotes the carding setting of the flat bars 14 and arrow C denotes the return transport direction of the flat bars 14.

Figure 2:
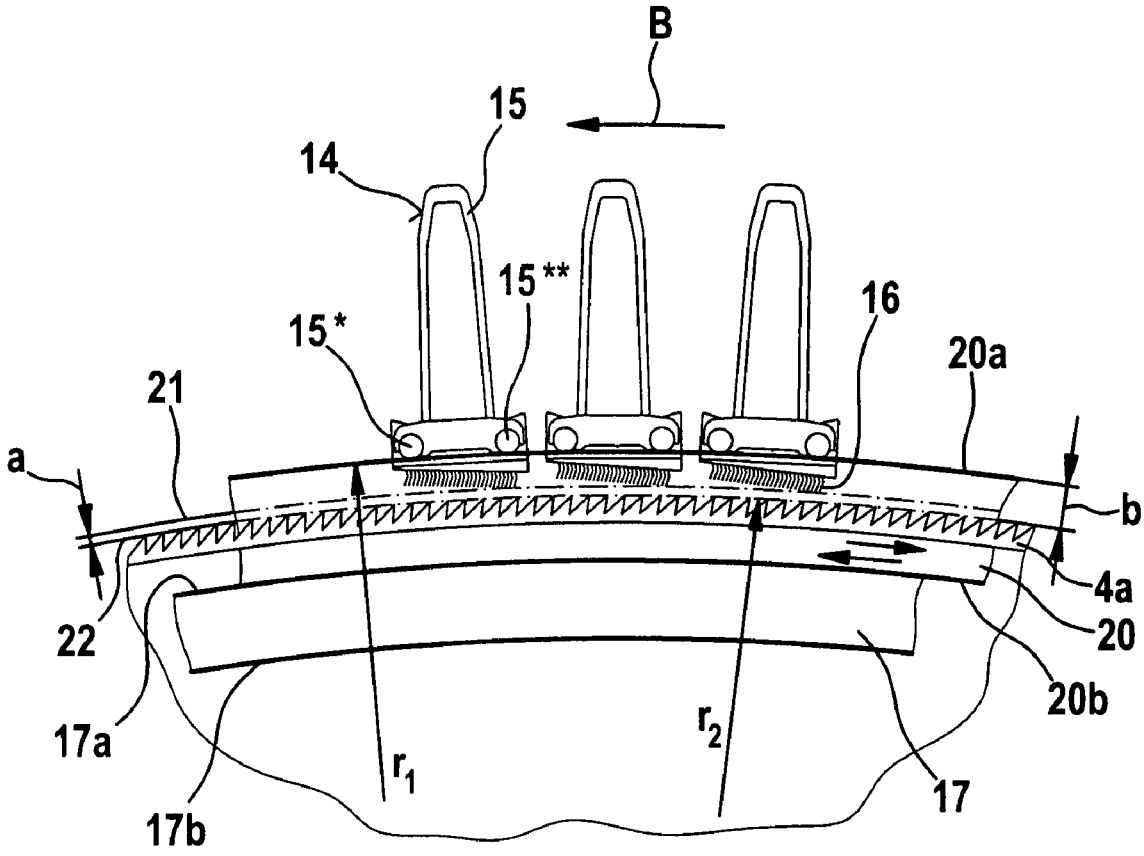
FIG. 2 is a side view of a portion of a revolving card flat assembly including card flats according to a first embodiment of the invention and a fragment from the first slideway of a two-sided slideway.

FIG. 2 shows one embodiment according to the invention. On each side of the card, a flexible bend 17 having several adjusting screws is secured laterally by screws to the machine frame. The flexible bend 17 has a convex outer surface 17*a* and an underside 17*b*. Above the flexible bend 17, there is a first slideway 20, for example, of anti-friction plastics material, which has a convex outer surface 20*a* and a concave inner surface 20*b*. The second slideway (on the other side of the machine) is not shown. The concave inner surface 20*b* lies on the convex outer surface 17*a*. Each flat bar 14 has at both ends a respective card flat head, to which two steel pins 15*, 15 are secured axially and slide in the direction of arrow B on the convex outer surface 20***a* of the slideway 20. The flat clothing strip 16 is mounted on the undersurface of the support body 15. The reference number 21 denotes the tip circle of the narrowest point of the flat clothings 16. On its circumference, the cylinder 4 has a cylinder clothing 4*a*, for example, saw-tooth clothing. The reference numeral 22 denotes the tip circle of the cylinder clothing 4*a*. The distance between the tip circle 21 and the tip circle 22 is denoted by the letter a, and is, for example, 0.20 mm. The distance between the convex outer surface 20*a* and the tip circle 22 is denoted by the letter b. The radius of the convex outer surface 20*a* is denoted by $r_1$ and the radius of the tip circle 22 is denoted by $r_2$. The radii $r_1$ and $r_2$ intersect at the mid-point M (see FIG. 1) of the cylinder 4.

Figure 3A:
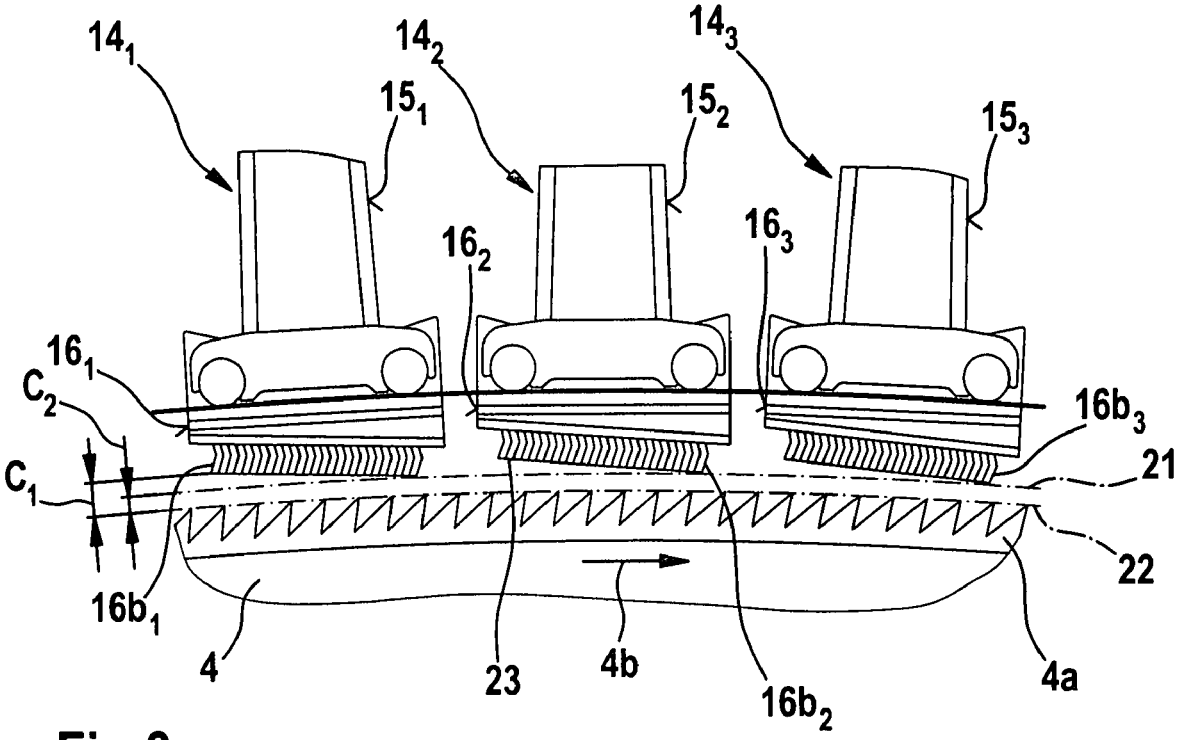
FIG. 3*a* shows three flat bars, the spacing between the tip plane of the flat clothings and the cylinder clothing decreasing in the direction of rotation of the cylinder.

FIG. 3*a* shows (drawn exaggeratedly) the decrease in the gap between the flat clothings $\mathbf{16}_1$, $\mathbf{16}_2$, $\mathbf{16}_3$ on the one hand and the cylinder clothing 4*a* on the other hand in the direction of rotation 4*b* of the cylinder 4. With the spacing between the free tips of the clothing tips $\mathbf{16}b_1$, $\mathbf{16}b_2$, $\mathbf{16}b_3$ of the flat clothings $\mathbf{16}_1$, $\mathbf{16}_2$, $\mathbf{16}_3$ and the cylinder clothing 4*a* in mind, the widest spacing is marked with $c_1$ and the narrowest spacing is marked with $c_2$. The spacings $c_1$ and $c_2$ appear in a radial direction in relation to the midpoint M (see FIG. 1) of the cylinder 4.

Figure 3B:
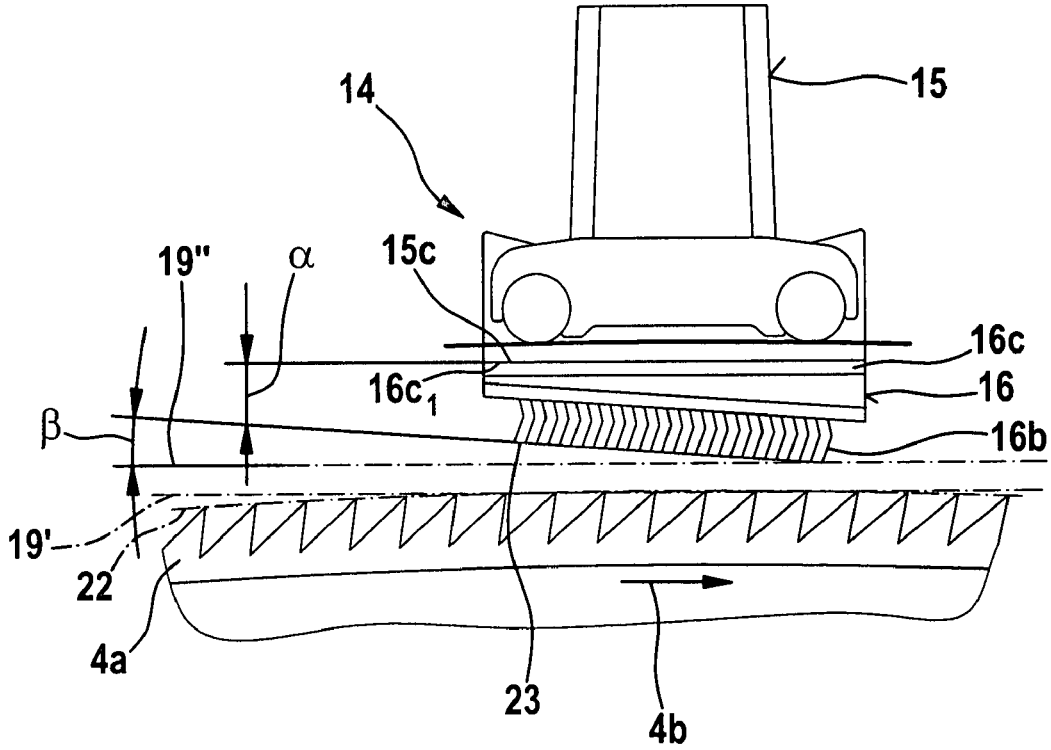
FIG. 3*b* shows a flat bar according to FIG. 3*a*, wherein the top face of the clothing strip and the tip plane of the flat clothing are not aligned parallel to one another, with an illustration of the angle $\alpha$ between flat surface and tip plane and of the angle $\beta$ for the offset.

Referring to FIG. 3*b*, which shows in enlargement one of the card flats of FIG. 3*a*, the clothing element 16 in the embodiment of FIGS. 3*a* and 3*b* has a top element 16*c*, the top face $\mathbf{16}c_1$ of which is in contact with lower face 15*c* of the support body 15, a bottom element in which clothing tips 16 are provided, and intermediate layer, of wedge-shaped configuration, between the top and bottom elements. The clothing tips 16 define a tip surface which in the embodiment of FIGS. 3*a* and 3*b* is a planar tip surface referred to herein as "tip plane".

Referring to FIGS. 3*a* and 3*b*, the top face $\mathbf{16}c_1$ of the top element 16*c* of the clothing element 16 and the tip plane 23 of the flat clothing 16*b* are not aligned parallel to one another.

According to FIG. 3*b*, the tip plane 23 of the flat clothing 16*b* and a notional surface 19"—arranged parallel to the tangent 19' to the tip circle 22 of the cylinder clothing 4*a* at the narrowest point $c_2$—are arranged at an angle β to one another (shown exaggerated in the drawing). At each flat bar 14 the tip plane 23 of the flat clothing 16*b* is consequently at an angle β of, for example, 0°55' in relation to the parallel surface 19". What is known as an offset, also called a taper, is consequently formed. The gap formed by the angle β between the flat clothing 16*b* and the cylinder clothing 4*a* closes in the direction of rotation 4*b* of the cylinder 4.

Furthermore, according to FIG. 3*b* the top face $\mathbf{16}c_1$ of the clothing element 16 and the tip plane 23 of the flat clothing 16*b* are arranged at an angle α to another (shown exaggerated in the drawing). The wedge formation created by the angle α opens in the direction of rotation 4*b* of the cylinder 4.

Figure 4:
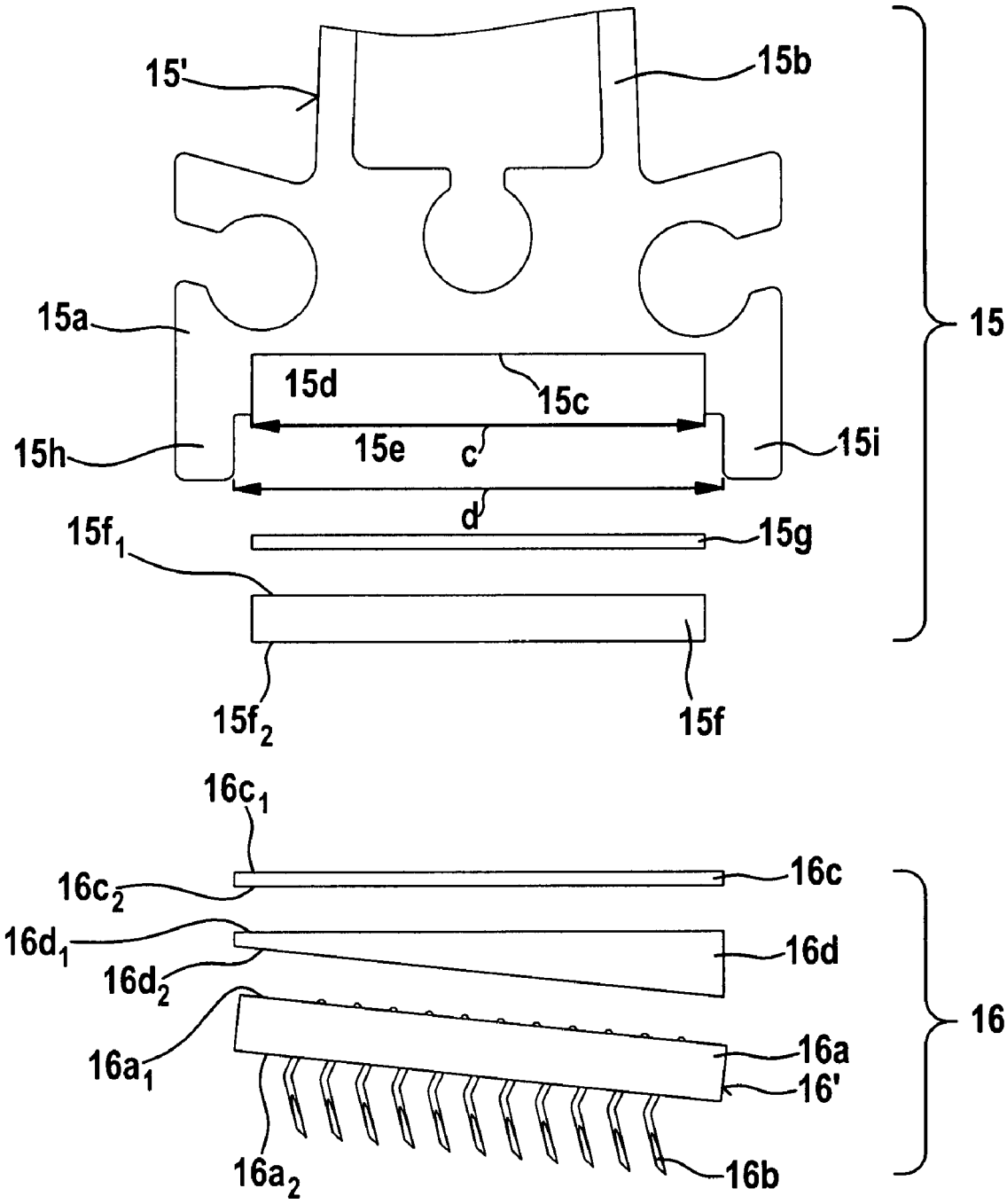
FIG. 4 shows the flat bar of FIGS. 3 and 3*a*, comprising flat support body and clothing strips, in an exploded view.

In the embodiment of FIG. 4, the flat bar 14 consists of a card flat support body 15 and a clothing element 16. The clothing element 16 is detachably (reversibly) secured to the card flat support body 15. The card flat support body 15 includes a profiled card flat body 15', which comprises a card flat foot 15*a* and a card flat back 15*b*. At the two ends of the elongate profiled card flat body 15', for example of extruded aluminium, moulded plastics or the like, there is a respective card flat head, which—in the embodiment according to FIGS. 2 and 3, each comprise two card flat pins 15* and 15. On the side remote from the flat bars 15***b*, two webs 15*h*, 15*i* are provided on the card flat foot 15*a* in the longitudinal direction, so that in the region of the bottom face 15*c* there is a two-tier recess 15*d*, 15*e*. The card flat support body 15 furthermore includes a magnetic element 15*f*, for example, a magnetic band, magnetic strip, magnetic rod or similar, which via its top face $\mathbf{15}f_1$ is fastened, in the upper recess 15*d*, by a layer of adhesive 15*g* to the bottom face 15*c*. The length of the card flat support body is, for example, 1 m.

In the embodiment shown in FIG. 4, the clothing element 16 comprises a clothing strip 16', which consists of a strip-form clothing carrier element 16*a*, for example, of textile material, and the flat clothing 16*b*. The flat clothing 16*b* consists of clothing tips 19 (wire hooks), the wire hooks being approximately U-shaped and fixed in the carrier element 16*a* by being pushed through the face $\mathbf{16}a_1$. The regions where the wire hooks change direction project beyond the face $\mathbf{16}a_1$. The ends of the wire hooks 19, the clothing tips, are free. The wire hooks consist of steel wire. The clothing element 16 furthermore includes a top element 16*c*, for example a steel plate strip, a steel band or similar, the bottom face $\mathbf{16}c_2$ of which is fixed by way of a connecting intermediate layer 16*d*, for example, an adhesive layer, to the top face $\mathbf{16}a_1$ of the clothing carrier element 16*a*. $\mathbf{16}d_1$ denotes the top face and $\mathbf{16}d_2$ denotes the bottom face of the intermediate layer 16*d*, the top face $\mathbf{16}d_1$ and the bottom face $\mathbf{16}d_2$ being so arranged that they are not parallel to one another, so that the cross-section of the intermediate layer 16*d* is wedge-shaped. The clothing element 16 is fixed with its components clothing strip 16', intermediate layer 16*d* and top element 16*c* in the recess 15*e*, so that only the flat clothing 16*b* projects beyond the bottom face of the card flat foot 15*a*. The fixing is so effected so that the top face $\mathbf{16}c_1$ of the flat element 16*c* (steel band) is in flat abutment with the bottom face $\mathbf{15}f_2$ of the magnetic element 15*f* (assembly plane). The positive-engaging connection between flat support body 15 and clothing element 16 is stable in operation. The carding forces that act on the flat clothing 16*b* are absorbed and compensated for by the webs 15*h*, 15*i* in the flat foot 15*a*.

Figure 5A:
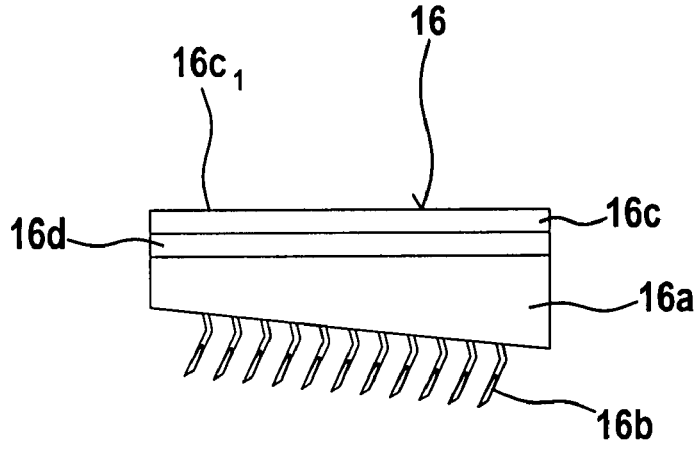
FIGS. 5*a*, 5*b* show two further embodiments, in which the clothing support part is of wedge-shaped construction in cross-section.
Figure 5B:
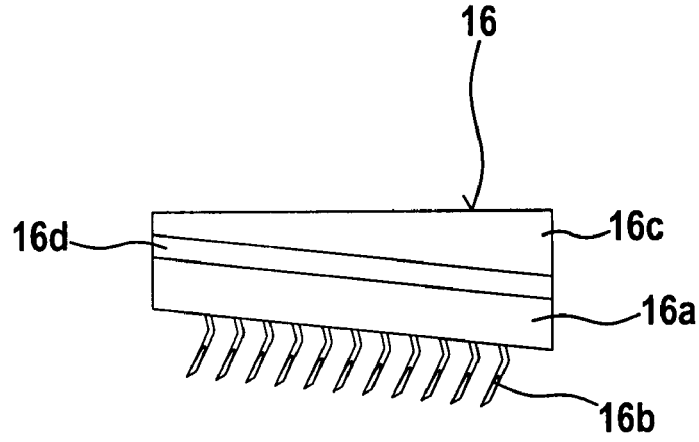

FIG. 5*a* shows a further embodiment of clothing element. The clothing carrier element 16*a* has a wedge-shaped construction in cross-section, whilst the top element 16*c* and the intermediate layer 16*d* are plane-parallel. In yet another embodiment shown in FIG. 5*b*, the top element 16*c* is of wedge-shaped construction in cross-section, whilst the clothing element 16*a* and the intermediate element 16 are plane-parallel.

Figure 6:
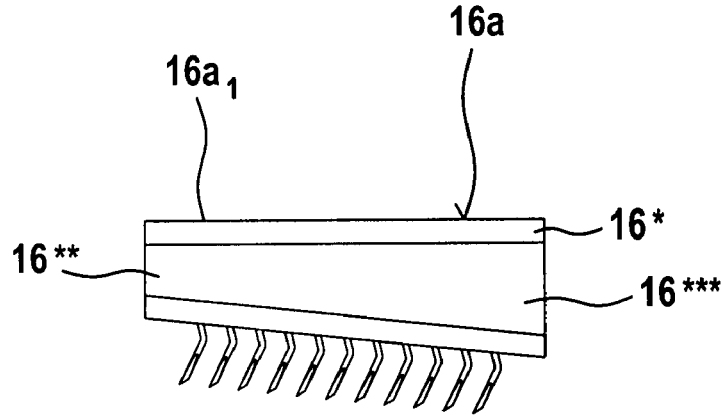
FIG. 6 shows yet another embodiment in which the clothing support part is of wedge-shaped construction in cross-section.

In the embodiment of FIG. 6, the clothing carrier element 16*a* consists of three layers 16*, 16 and 16*****, that is, layers, for example, of textile material and plastics. Whereas the upper layer 16* and the bottom layer 16*** are of plane-parallel construction, the middle layer 16** is wedge-shaped in cross-section. The top face $\mathbf{16}a_1$ may, for example, be adhesively secured to the bottom face 15***c*. The carrier element 16*a* shown in FIG. 6 can also be arranged in place of the carrier element 16*a* shown in FIG. 5*a*.

Although the foregoing invention has been described in detail by way of illustration and example for purposes of understanding, it will be obvious that changes and modifications may be practised within the scope of the appended claims.

What is claimed is:

1. A card flat for use on a carding machine, comprising:

a support body;

a magnetic element; and a clothing element having an upper surface, wherein the upper surface is reversibly detachably coupled to the support body by the magnetic element, the clothing element comprising:

clothing having tips, wherein the tips define a tip surface, and a clothing carrier layer, wherein the clothing are arranged in the clothing carrier layer and the upper surface and the tip surface are oriented in a non-parallel relationship.

2. A card flat according to claim 1, wherein the tip surface is substantially planar and the upper surface of the clothing element and the tip surface are arranged at an angle to one another.

3. A card flat according to claim 1, in which the clothing element is of substantially wedge-shaped construction.

4. A card flat according to claim 3, in which the clothing element comprises at least two layers, wherein at least one of the two layers is of substantially wedge-shaped construction.

5. A card flat according to claim 1, in which the clothing element further comprises an upper layer, said upper layer including said upper surface.

6. A card flat according to claim 5, further comprising an intermediate layer arranged between the clothing carrier layer and the upper layer, and at least one of said upper layer, intermediate layer and clothing carrier layer is of substantially wedge-shaped construction.

7. A card flat according to claim 6, wherein the support body further comprises a bottom face, wherein the upper surface of the clothing element and the bottom face are reversibly detachably joined to one another by the magnetic element.

8. A card flat according to claim 1, in which the clothing element and/or the clothing carrier layer is exchangeable.

9. A card flat according to claim 1, in which the clothing has a curved tip surface.

10. A card flat according to claim 1, in which the non-parallel alignment extends partially over the width of the clothing element.

11. A card flat according to claim 1, in which the clothing arranged in the carrier layer comprises wires, wherein the wires are approximately U-shaped and inserted so that a cross-member of the U-shaped wires runs on a rear side of the carrier layer.

12. A card flat according to claim 1, in which the support body has a base with a bottom face and the clothing element is received in a recess in the bottom face of the support body, the recess being defined by at least two lateral webs on longitudinal sides of the base of the support body.

13. A card flat for use on a carding machine, comprising:

a support body, wherein the support body comprises a magnet; and a clothing element having an upper surface, wherein the upper surface is reversibly detachably coupled to the support body by the magnetic, the clothing element comprising:

clothing having tips, wherein the tips define a tip surface, a clothing carrier layer, wherein the clothing are arranged in the clothing carrier layer and the upper surface and the tip surface are oriented in a non-parallel relationship, and a sheet metal plate and a compensating layer of adhesive, the sheet metal plate positionable to connect with the magnet.

14. A card flat according to claim 13, wherein the sheet metal plate comprises a body of magnetic material arranged on a rear side of the clothing element and extending in a longitudinal direction of the flat bar.

15. A card flat according to claim 1, wherein the support body comprises an extruded, hollow profile of a light metal.

16. A card flat according to claim 1, in which the support body comprises fibre-reinforced plastics material, in which the magnetic element is integrated in the fibre-reinforced plastics material for effecting magnetic connection of the clothing element to the support body.

17. A card flat according to claim 1, wherein the clothing has regions with different clothing parameters, wherein each of said regions has clothing tips that are used to form a fibre zone, each zone forming a respective tip surface.

18. A card flat according to claim 1, wherein the card flat is adapted for use as a part of a revolving flat.

19. A card flat according to claim 1, wherein the card flat is adapted for use as a stationary carding element.

20. An apparatus on a flat card for fibres, comprising:

a rotatable cylinder clothing; and at least one flat bar including:

a support body, a magnetic element, a strip-form clothing element reversibly detachably secured to the support body by the magnetic element, the clothing element having a flat clothing, wherein the flat clothing comprises wire hooks defining a tip surface positioned opposite the cylinder clothing, wherein a spacing between the tip surface of the flat clothing and a tip circle of the cylinder clothing decreases in a direction of rotation of the cylinder clothing and a notional surface arranged parallel to a tangent to the tip circle of the cylinder clothing is defined at a narrowest point, wherein the tip surface of the flat clothing and the notional surface are arranged at an angle to one another, and wherein a top face of the strip-form clothing element and the tip surface of the flat clothing are aligned non-parallel with one another.

* * * * *

UNITED STATES PATENT AND TRADEMARK OFFICE

CERTIFICATE OF CORRECTION

PATENT NO. : 7,665,188 B2
APPLICATION NO. : 11/705716
DATED : February 23, 2010
INVENTOR(S) : Thomas Landmesser It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 403 days.

Signed and Sealed this

Seventh Day of December, 2010

David J. Kappos

David J. Kappos
*Director of the United States Patent and Trademark Office*